United States Patent [19]

Fritz et al.

[11] 4,023,781

[45] May 17, 1977

[54] TUYERE FOR METALLURGICAL VESSELS

[75] Inventors: Ernst Fritz; Hans Georg Fassbinder, both of Sulzbach-Rosenberg, Germany

[73] Assignee: Eisenwerk-Gesellschaft Maximilianshutte mbH, Sulzbach-Rosenberg, Germany

[22] Filed: Jan. 28, 1976

[21] Appl. No.: 652,917

Related U.S. Application Data

[62] Division of Ser. No. 468,774, May 10, 1974.

[30] Foreign Application Priority Data

May 12, 1973 Germany ..... 2324086

[52] U.S. Cl. ..... 266/44; 75/60; 266/222; 266/268; 266/281

[51] Int. Cl.[2] ..... C21C 5/48

[58] Field of Search ..... 75/60; 110/182.5; 122/6.6; 266/44, 47, 222, 268, 281

[56] References Cited

UNITED STATES PATENTS

| | | | |
|---|---|---|---|
| 405,392 | 6/1889 | Bertrand | 75/60 X |
| 3,811,386 | 5/1974 | Knuppel et al. | 266/222 |
| 3,817,505 | 6/1974 | LeRoy et al. | 266/222 |
| 3,819,165 | 6/1974 | Courard et al. | 266/268 |
| 3,829,073 | 8/1974 | Courard | 266/222 |

*Primary Examiner*—Gerald A. Dost
*Assistant Examiner*—Paul A. Bell
*Attorney, Agent, or Firm*—Lawrence I. Field

[57] ABSTRACT

This invention relates to a process for refining metals in a refining vessel, by means of a tuyere embedded in the bottom or sidewall of the vessel and through which a refining gas is blown into the vessel. The tuyere is composed of at least three concentric pipes, the refining gas being made to pass through the central pipe and a protective medium being made to pass into the vessel through the spaces between the pipes which surround the central pipe. All of the pipes except the outermost pipe which is fixedly embedded in the refractory lining of the vessel, are individually movable longitudinally into the vessel.

3 Claims, 4 Drawing Figures

TUYERE FOR METALLURGICAL VESSELS

This is a division of application Ser. No. 468,774, filed May 10, 1974.

This invention relates to improvements in a tuyere for supplying a refining gas, especially oxygen, through the wall of a refining vessel and underneath the bath surface, the refining gas being made to pass through a center pipe of said tuyere and a protective medium being made to pass through a concentric outer pipe, said refining gas and protective medium being introduced into the melt, and to the use of such a tuyere.

Processes of the above mentioned kind are known from German Pat. No. 1,583,968 and U.S. Pat. No. 3,706,549, issued Dec. 19, 1972. These known processes may be carried out with or without lime-laden oxygen and preferably are executed using gaseous or liquid hydrocarbon protective medium such as methane, natural gas, propane, butane, ethane or light heating fuel. In order to maintain the annular space between the center and outer pipes as constant as possible during a convertor campaign, spacers such as fins or ribs, studs or helices may be mounted on the outside of the center pipe or else also on the inside of the outer pipe. Maintaining as even a wear as possible of the tuyeres and of the surrounding masonry is essential for prolonging the life of the convertor. Even wear may be achieved by adjusting the flow rate of the protective medium. However, if the flow rate is too low, there will be premature wear of the tuyeres with respect to the surrounding masonry, said wear depending on the rate of protective medium being used possibly leading to instantaneous back-burning of an individual tuyere. If natural gas is used, for instance, as the protective medium, at rates appreciably or essentially less than 5% by volume, there will be premature wear of the tuyere.

Practical experience has shown that even when properly selecting the rate of the protective medium, there may be premature wear, i.e., back-burning of individual tuyeres. The cause may be rust or welding beads obstructing the supply lines of the protective medium and/or of the annular space between the tuyere pipes. When premature wear occurs in a tuyere, the particular tuyere is usually removed from operation and sealed. The crater caused by the premature wear is also sealed in a conventional manner with a refractory material. Such a measure, however, is likely to be unsatisfactory because only a few tuyeres are required for refining with oxygen and therefore the elmination of one tuyere has an appreciably greater effect than for conventional refining with air or with oxygen-enriched air. Hence in practice the designer of the refining vessels provides one or two more tuyeres beyond the required number so that the capability for refining with an adequate number of tuyeres will remain even when there is unforeseen back-burning or clogging of one or more tuyeres.

Side-blowing refining vessels provide the advantage of allowing an increase in blowing cross-section of the tuyeres and in gas pressure as compared to bottom-blowing refining vessels, without incurring the danger of blowing through the melt. Therefore, side-blowing refining vessels frequently will be equipped with only one or two tuyeres mounted in the side wall. In such instances, sealing a tuyere in case of premature wear is entirely out of the question, since insufficient tuyere capacity would remain.

Practical experience furthermore has shown that the masonry immediately surrounding the tuyeres will wear somewhat faster than the remaining masonry. Consequently a new bottom must normally be inserted once during a convertor campaign for a bottom-blown convertor.

The present invention is directed to overcoming the previously mentioned drawbacks and especially to create a tuyere which will allow countering premature wear without the necessity of removing the tuyere from operation. The solution to the problem consists in so mounting the center and outer pipes of the tuyeres in at least one sleeve or sheath pipe from which both pipes are spaced, mounted so that they are axially movable. In this manner there is provided at least one additional annular space for supplying the protective medium. This also makes possible changing or axially moving the center and outer pipe, for instance between two charges, in order to affect the masonry wear in the immediate vicinity of the tuyeres. This is achieved by the mechanism of porous iron deposit formation including slag and refractory substances. Such deposits occur when the amount of the protective medium supplied through the annular space is increased. Such deposits protect the tuyeres against premature burning and against mechanical damages from the solid input, provided their formation is kept within limits.

In addition, supplying the protective medium through several annular spaces will also reduce the dange of tuyere back-burning. Finally, the movable arrangement of the pipe allows quick repairs between two charges if there is back-burning. Thus, in case of funnel or crater formation, the center and outer pipes may be advanced as far as the level of the intact masonry, and then the funnel or crater may be filled with refractory by spraying, caulking or tamping. Depending on the depth of the crater, one may also withdraw the movable pipes and replace them by new ones.

Filling the funnel or crater will make unavailable the outer annular space; this however, will be of relatively minor significance, the annular space involved being supplied with protective medium through a supply line of its own which can be shut off. There is also the possibility of keeping the outer annular space supplied with protective medium after filling the funnel or crater. When making use of hydrocarbons, this will be advantageous because they will penetrate the filler substance and be cracked therein. Carbon will be generated, which will cause both solid bonding of the filler substance to the original, surrounding masonry and a considerable increase in the life of said filler substance. When the center and outer pipes are surrounded by several sheath pipes and hence by several annular slots or spaces, all pipes will be advanced every time except the outer sheath pipe, so that one annular space is removed from operation temporarily until the masonry inclusive of the filler substance if worn down to the level of the outer sheath pipe.

Using at least one additional sheath pipe with its own medium supply furthermore entails the advantage of the outer annular space preferably being supplied with the protective medium in order to keep it free from alien substances such as steel or slag or other contaminations when advancing the inside pipes. This may be extended to the point that the inside annular spaces will no longer be supplied with protective medium and that the protection of the tuyere orifices will be effected by the protective medium issuing from only the outer annular space. If for instance metal or slag were to penetrate the inside annular space(s), the inside pipes will in any event maintain their capability of motion and further may be very easily exchanged.

Preferably all tuyeres are provided with at least one sheath pipe. It is therefore possible to set the convertor to rest following a given number of charges and to advance all inside pipes by a given amount and to rebuild the masonry in the region of the tuyeres or over the whole bottom. In this manner one may, for instance, avoid changing the bottom in a bottom-blown convertor, and the bottom may be kept operative until the remaining masonry of the convertor also will be worn enough for replacement.

In order to prevent penetration of the filler substance, for instance magnesite or dolomite with tar combination, into the tuyeres, one may blow with inert gas(es) during the period of repairs. It is also possible to install new tuyeres by sealing their outlets with detachable covers that may be removed during blowing or may be melted by the hot metal.

Two additional outer annular spaces according to the invention also may be separated from one another by an intermediate layer of refractory material. The thickness of the cylindrical intermediate layer amounts to 5–25 cm and permits easy exchange of the movable pipes. Also, the outer annular space may be conically tapered in the direction of the tuyere tip so as to facilitate installation of the movable pipes.

Using a porous material for bounding two outer annular spaces entails the advantage of providing with protective medium the outermost annular space through apertures or through the pores in the refractory material. Furthermore, the discharge of the protective medium from a porous material at the melt contact area will to some degree enhance the desired deposit formation.

Conventional carbon steels, stainless steels, especially chromium and chromium-nickel steels, and copper, may be used as pipe materials for the tuyere(s) of the invention. Thus, tuyeres found to be useful comprised a center pipe of hardened carbon steel or of a steel alloy of about 0.3–1.5% carbon, 5–30% chromium, 1.0% molybdenum, 1.0% maganese and 1.0% silicon, balance iron, the wall thickness being 2–8mm. The annular space between the center pipe and a concentric outer pipe of ordinary soft steel with a wall thickness of about 2 mm amounted to approximately 1 mm. The wall thickness of the outermost sheath pipe is 3–10 mm; preferably it will be 5 mm so as to provide the tuyere with sufficient stability and resistance to deformation. The sheath pipe may consist of copper, hardened steel or of a ceramic material, which has been found to be especially practical, its use avoiding welding to the neighboring metal pipe in the case of high temperatures. Long-term operational observations have shown that the resistance of oxygen pipes made of hardened carbon steel will also be sufficient if oxygen laden with powdery slag-forming agents is being introduced; hence lining the oxygen pipe with a special wear-resistant layer is not required.

The tuyere of the invention also may be used as a burner, for instance for preheating the scrap or for warming the refining vessel. In this case the same medium, preferably hydrocarbons, will be introduced through all annular spaces. The outer annular space most of the time being wider than the inner one, there will be no need to keep the pressure of the combustible medium much above that of the oxygen.

One may also introduce or blow different and varyingly combustible media into the individual annular spaces, for instance gaseous hydrocarbons through the inner annular space and liquid hydrocarbons through the outer annular space.

An inert gas may be blown through the outer annular space during refining. As regards tuyeres with several sheath pipes, an inert gas acting as protective medium may also be blown through the corresponding outer annular spaces. In order to allow interchanging individual media and to protect the tuyeres (especially when the convertor is tilted) with air or with an inert gas, the individual annular spaces and the oxygen pipes are each provided with their own supply lines which are equipped with control means. This provides the feasibility of consolidating into groups the oxygen pipes and/or the annular spaces, and to control them as groups. One may in this manner supply individual annular spaces with special media or else to keep them out of operation entirely.

The invention will be more fully understood from the following description taken in conjunction with the drawings in which.

Figure 1:
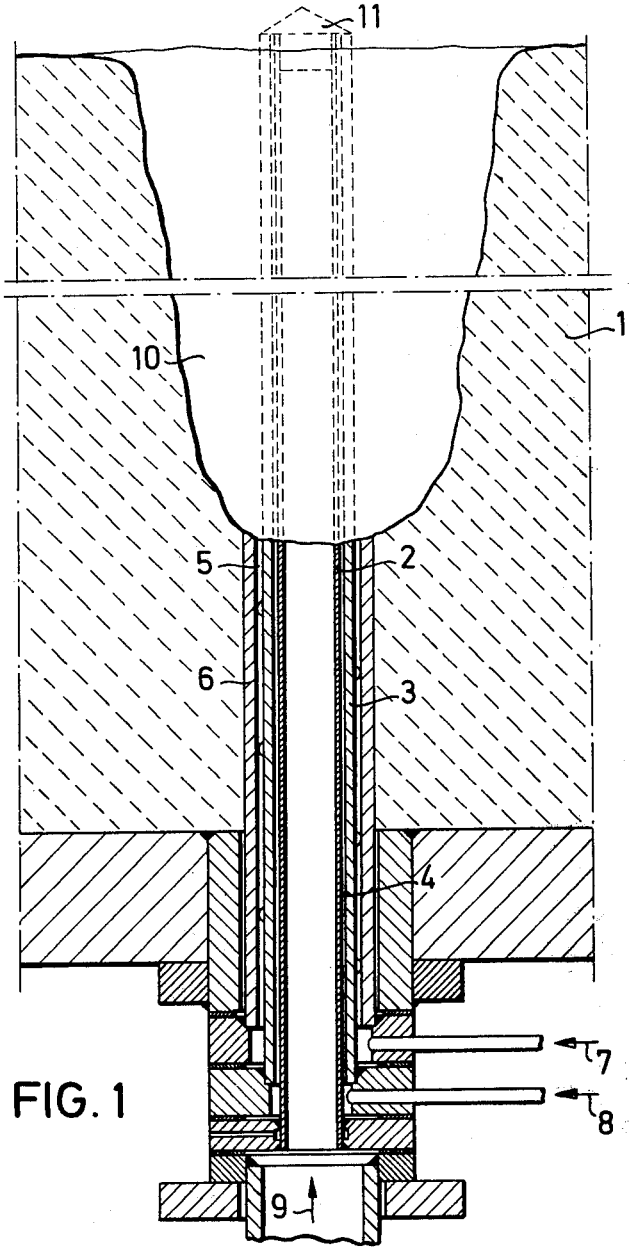
FIG. 1 is a fragmentary view taken in longitudinal section along a tuyere of the invention provided with a sheath pipe, following crater-like erosion of the surrounding masonry.
Figure 2:
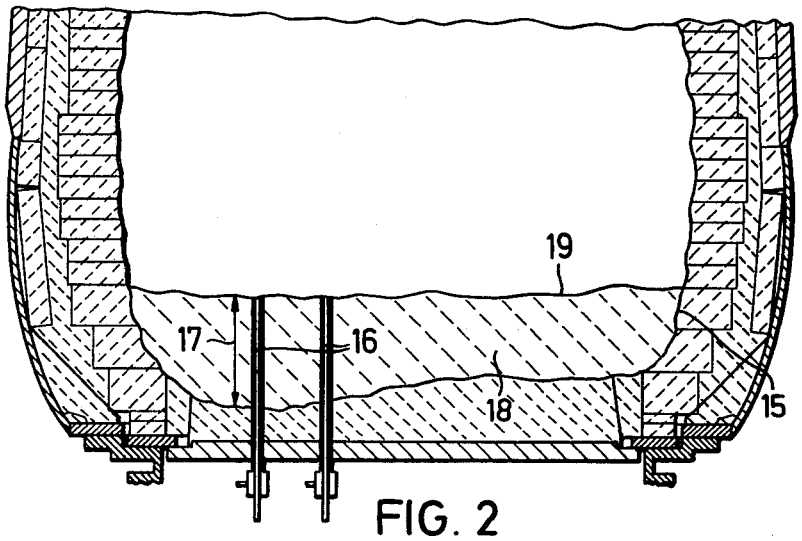
FIG. 2 is an axial section through a convertor following partial bottom wear, showing a filling placed on the worn bottom.
Figure 4:
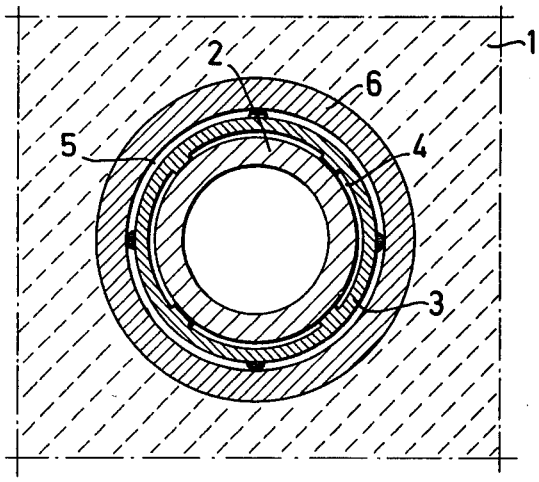
FIG. 4 is a top plan view in section of the tuyere of the invention.

As shown in FIGS. 1, 2 and 4 a tuyere consists of an oxygen pipe 2 and of a concentric outer pipe 3, disposed around the oxygen pipe 2 so as to define an annular space 4 in conjunction with the oxygen pipe. The tuyere is embedded in the refractory lining material 1 of a refining vessel (not shown), for instance in the bottom of a convertor or in the sidewall of a convertor. This much of the tuyere construction is known per se. In the improved tuyere of the present invention, the twopipe tuyere is movably mounted in a fairly thick sheath pipe 6, which together with outer pipe 3 forms an outer annular space 5. Annular spaces 4 and 5 and provided with separate supply lines 8 and 7 respectively, by which they are fed with protective media which maybe either the same or different protective media. The center oxygen pipe 2 is supplied with oxygen from a separate supply line. The oxygen may be carrying powdery solids such as slag forming agents in the form of lime dust. It may happen in operation that the tuyere supplying a protective medium will burn back and that a crater 10 will form in the refractory material 1. In order to be able to fill such a crater, tuyere pipes 2 and 3 are advanced axially along the sheath pipe 6 into the vessel interior, that is, approximately up to the level of the surrounding refractory material, as indicated by the dashed lines in FIG. 1. If the pipe lengths should be insufficient for that purpose, the tuyere pipes very easily may be made to the required length by adding new pipe segments. While this is being effected, the tuyere orifice is sealed by a cap 11 in order to prevent introduction of impurities, said cap being either blown off or burned away when operation of the vessel resumes.

Following the advance of tuyere pipes 2 and 3 to the position shown in FIG. 1, crater 10 may be filled with a refractory substance approximately up to the level of the surrounding masonry. While the use of the outer annular space 5 for blowing in a protective medium will be lost thereby, because sheath pipe 6 is kept fixed in the refractory masonry, said outer annular space will again be operative after said masonry has burned back enough to reexpose space 5. It does not matter in this respect whether the supply of protective medium to annular space 5 is shut off or continued during the period that the refractory is wearing away.

If the wear of the masonry surrounding the tuyeres is essentially even, for instance as shown in the convertor bottom of FIG. 2, and corresponding to the wear line 15, illustrating the bottom wear after blowing approximately 200 charges, then all the tuyeres 16 are advanced in the manner described in relation to FIG. 1 to the desired bottom level, that is, by the length of arrow 17. Then the bottom is filled to the new bottom level 19 with a refractory material such as tar-bonded dolomite or magnesite, or with chemically bonding or ceramically hardening substances. The bottom may be used for approximately another 200 charges in this manner, before requiring replacement.

Figure 3:
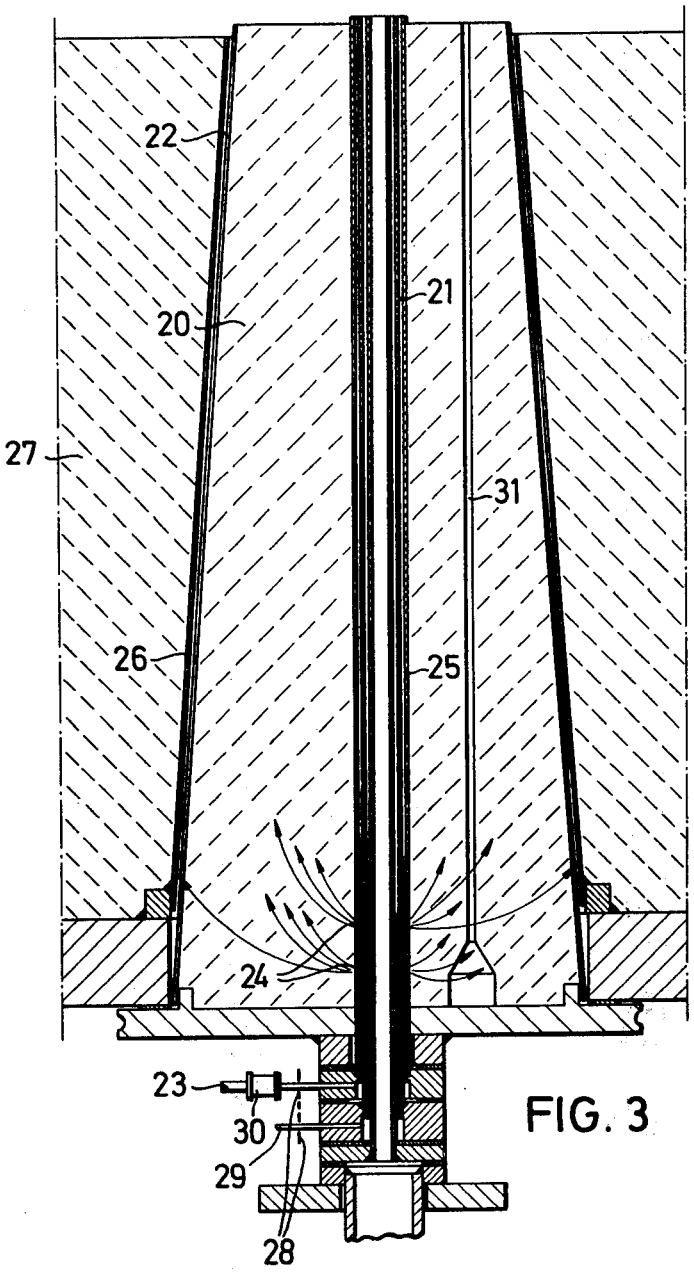
FIG. 3 is an axial longitudinal section like FIG. 1 through a modified tuyere of the invention provided with a sheath pipe of appreciable wall thickness.

As regards the tuyere design of FIG. 3, the oxygen pipe and the surrounding outer pipe are surrounded by two sheath pipes 25 and 26. Sheath 25 and the outer pipe form an annular space 21 provided with protective medium by a supply line 23. Sheath pipe 25 is surrounded by a cone 20 made of refractory material, an outer annular slot 22 resulting between said cone and outer sheath pipe 26 which also in conical and which is seated in the refractory masonry 27. The inner annular space between the center or oxygen pipe and the surrounding outer pipe is provided with protective medium from a supply line 29 equipped with a diaphragm 28 for limiting the rate of said medium. A corresponding diaphragm 28 is located in supply line 23, which is furthermore provided with a pressure switch 30 only then admitting the supply line into the annular space 21 when the protective medium begins to flow. One prevents in this manner any low pressure inert gas flowing through the inner annular space from reaching the outer annular space 21.

The protective medium supplied by line 23 passes through apertures at the bottom of sheath pipe 25 into porous cone 20 and from latter into outer annular space 22 and also to the front side of cone 20. Protective medium issuing from the top side was found to be enhancing durability. Cone 20 may also be provided with channels 31 parallel to the axis in order to direct the protective medium entering the refractory material toward the cone top side.

The tuyere of the invention provides the advantage of higher economic operation of refining because rapid masonry wear in the vicinity adjacent to the tuyeres previously required changing tuyeres or bottoms, in part repeatedly, in the bottom-blown convertor. The tuyere of the invention further allows installing new pipes or a new cone. Also, a refining vessel equipped with the tuyers of the invention requires no excess tuyeres because there no longer is danger a tuyere may fail on account of premature tuyere wear or crater formation. Therefore the number of tuyeres may be selected to correspond precisely to the required blowing cross-section and refining gas pressure. Thus, a 200 ton convertor for refining pig iron to steel may be equipped with 12 tuyeres per the invention of which the center of oxygen pipes will have a wall thickness of 2–8 e.g., 5mm and an ID of 38mm, consisting of hardened carbon steel or alloy steel and being surrounded by a soft steel pipe about 2mm in wall thickness and spaced 1mm away from the center pipe. The soft steel pipe is surrounded by a sheath pipe approximately 6 mm thick which is spaced 1 mm away from the soft steel pipe said sheath pipe being of hardened steel. The means used to maintain desired pipe spacings are the ribs or studs shown schematically in FIG. 4.

We claim:

1. A process for operating a refractory lined refining vessel for the refining of molten metals, wherein at least one stream of refining gas is introduced into a bath of molten metal in said vessel, said refining gas being introduced into said metal together with a sheath of protective media surrounding the stream of refining gas, through a multiple pipe tuyere, and wherein, as a result of the introduction of said refining gas, the mouth of the tuyere and the refractory lining adjacent to the mouth of the tuyere become eroded, threatening the useful life of the refining vessel, the improvement which comprises providing a tuyere which includes a sheath pipe embedded in the refractory lining of the refining vessel and at least two pipes axially slidable inside said sheath pipe for introducing said refining gas and said protective medium into said bath, and after said refractory lining and said tuyere have been eroded, advancing said axially slidable pipes into said vessel so that they extend into the vessel and project beyond the refractory lining, and applying refractory to build up the worn away lining at least to about the distance to which the axially slidable tuyere pipes project into the vessel.

2. The process of claim 1 wherein the refractory material is a tar-bonded magnesite or dolomite.

3. The process of claim 1 wherein the axially movable pipes are withdrawn entirely and replaced by longer pipes.

* * * * *